United States Patent [19]

Tokumitsu et al.

[11] Patent Number: 4,788,540

[45] Date of Patent: Nov. 29, 1988

[54] RASTER SCAN IMAGE DATA DISPLAY CONTROLLER INCLUDING MEANS FOR REDUCING FLICKERING

[75] Inventors: Shigenori Tokumitsu; Masaaki Nishiura, both of Fukaya, Japan

[73] Assignee: Kabushiki Kaisha Toshiba, Kawasaki, Japan

[21] Appl. No.: 886,428

[22] Filed: Jul. 17, 1986

[30] Foreign Application Priority Data

Feb. 20, 1985 [JP] Japan ..... 60-30289
Jul. 19, 1985 [JP] Japan ..... 60-159340

[51] Int. Cl.[4] ..... G09G 1/00

[52] U.S. Cl. ..... 340/789; 340/732; 340/733; 358/152

[58] Field of Search ..... 340/723, 724, 726, 728, 340/744, 789, 732, 733; 358/148, 150, 151, 152, 158

[56] References Cited

U.S. PATENT DOCUMENTS 4,445,114 4/1984 Stubben ..... 340/726
4,608,602 8/1986 Grantham-Hill ..... 358/152
4,649,378 3/1987 Johnson et al. ..... 340/728

FOREIGN PATENT DOCUMENTS 57-14067 3/1982 Japan .
2083326 3/1982 United Kingdom .

*Primary Examiner*—Gerald L. Brigance
*Assistant Examiner*—Jeffery A. Brier
*Attorney, Agent, or Firm*—Cushman, Darby & Cushman

[57] ABSTRACT

A raster scan image data display controller including a means for reducing flickering comprises an image memory for storing image data items at horizontal and vertical display addresses corresponding to horizontal and vertical coordinates on an image display area, a read-out device for supplying the horizontal and vertical display addresses to the image memory and reading out the image data items from the image memory, a display device for interlaced displaying of the read-out image data on paired scanning lines of two types of fields which are to be formed by a raster scan, a timing control device for synchronizing the horizontal and vertical display addresses with the raster scan of the display device, and a timing switching device for permitting said paired scanning lines of two types of fields formed by the raster scan in association with a timing control by the timing control device, to be switched, so as to select a pair of scanning lines which are situated close to each other.

6 Claims, 12 Drawing Sheets

RASTER SCAN IMAGE DATA DISPLAY CONTROLLER INCLUDING MEANS FOR REDUCING FLICKERING

BACKGROUND OF THE INVENTION

1. The Field of Art

This invention relates to a raster scan image data display controller including means for reducing flickering and, in particular, to an apparatus for effectively reducing the flickering produced when a still image is displayed by means of interlaced scanning.

2. The Prior Art

A known system, such as a teletext system, uses a display controller which enables image data items stored in an image memory to be displayed on a raster scan-type interlacing display unit, such as a CRT. A receiving device of such a conventional teletext system extracts a teletext (-like) signal superimposed on a television signal, stores it in an image memory, reads out the character signal from the image memory and produces a corresponding still image on a display unit, such as a CRT.

A still image displayed by means of interlaced scanning, with a field frequency of 60 Hz (frame frequency of 30 Hz) will be explained below, by way of example, with reference to FIGS. 6A to 6C. In FIGS. 6A to 6C, $L_{40}$ to $L_{42}$ and $L_{303}$ to $L_{305}$ show scanning lines, noting that the scanning lines $L_{40}$ to $L_{42}$, indicated by a broken line, are formed at an odd-numbered field period and that the scanning lines $L_{303}$ to $L_{305}$, indicated by a solid line, are formed at an even-numbered field period. Blocks $B_1$ to $B_3$ show one pixel each and the image data items of the image memory are used for both the odd- and even-numbered field periods; for example, for the scanning lines $L_{40}$ and $L_{303}$.

In the aforementioned image display using interlaced scanning, two fields, i.e., the odd- and even-numbered fields, are vertically shifted a predetermined amount on the display screen to provide a one image plane. In practice, the scanning line for one of the two fields—for example, the even-numbered field—is displaced, as shown in FIGS. 6B and 6C, due to a variation, for example, in the deflection system of the display unit.

In FIG. 6B two scanning lines for displaying the corresponding image data item are located close to each other, with their image blocks overlapping on this pair of scanning lines. In this case there is no problem because of the presence of a Flickering-prevention effect. That is, the same image data items read out of the image memory are displayed in display areas indicated by $b_1$ and $b_3$ in FIG. 6B, in which case the frame frequency is 30 Hz. Since the display area indicated by $b_2$, in FIG. 6B, is scanned by the even- and odd-numbered fields, flickering decreases, due to the frame frequency of 60 Hz.

In the case of FIG. 6C, on the other hand, the paired scanning lines are located away from each other, resulting in a flickering image, due to image fluctuation, and thus in poor image resolution. That is, blocks $B_1$ of one pixel in FIG. 6C are separated by a lower brilliance display area $C_1$. In dislay area $C_2$, blocks $B_1$ and $B_2$, belonging to two different pixels, partially overlap, with the result that the different pixels are displayed overlapping in display area $C_2$ with a repetition frequency of 60 Hz, and consequently, a flickering image occurs there.

The flickering occurring in the two directions, due to interlaced scanning, differs for every display device, and, in the conventional display controller, poor image resolution occurs due to the presence of the poorly-defined pixels, resulting in the appearance of prominent flickering, a serious visual problem.

SUMMARY OF THE INVENTION

It is, therefore, an object of this invention to provide a new and improved raster scan image data display controller including means for reducing flickering, which can reduce such flickering on the display screen under well-controlled interlaced scanning, to provide a clearly defined image display.

According to this invention there is provided a raster scan image data display controller including means for reducing flickering, which comprises:

an image memory for storing image data items at horizontal and vertical display addresses corresponding to horizontal and vertical coordinates in an image display area, so as to display them on an image screen;

a read-out device for supplying the horizontal and vertical display addresses to the image memory and reading out the image data items from the image memory;

a display device for interlaced displaying of the read-out image data items on paired scanning lines of two types of fields which are to be formed by a raster scan;

a timing control device for synchronizing the horizontal and vertical display addresses with the raster scan of the display device; and a timing switching device for permitting the paired scanning lines of the two types of fields formed by the raster scan, in association with a timing control by the timing control device, to be alternately switched, so as to substantially select a pair of scanning lines which are situated close to each other.

BRIEF DESCRIPTION OF THE DRAWINGS

These and other objects and features of this invention can be understood through the following embodiments, with reference to the accompanying drawings, in which.

DETAILED DESCRIPTION OF THE PREFERRED EMBODIMENTS

The embodiments of this invention will be explained below, with reference to the accompanying drawings, as applied to a television receiver of a teletext system.

Figure 1:
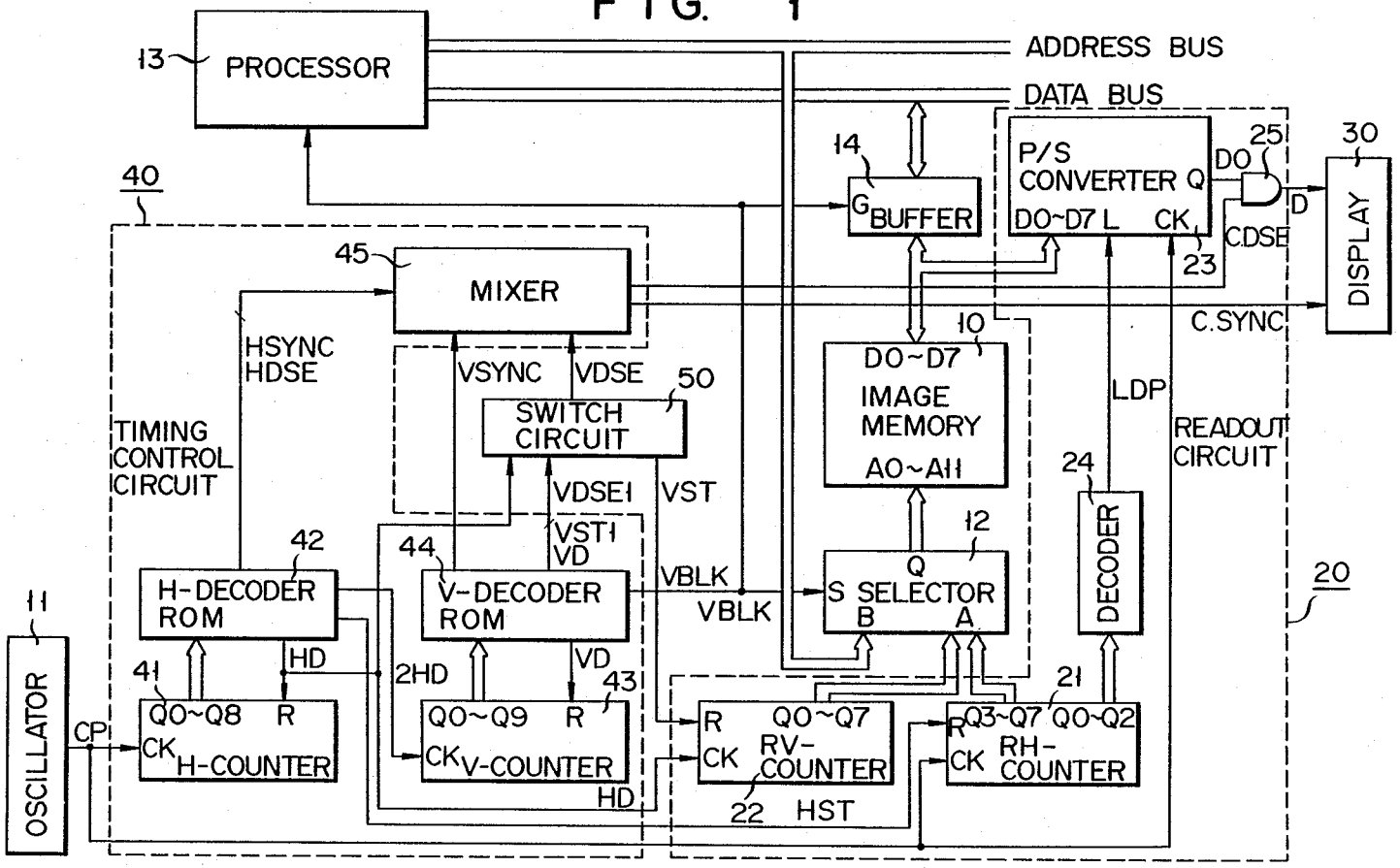
FIG. 1 is a block diagram showing a display controller according to a first embodiment of this invention.

FIG. 1 is a circuit diagram showing a display controller according to a first embodiment of this invention.

Figure 2:
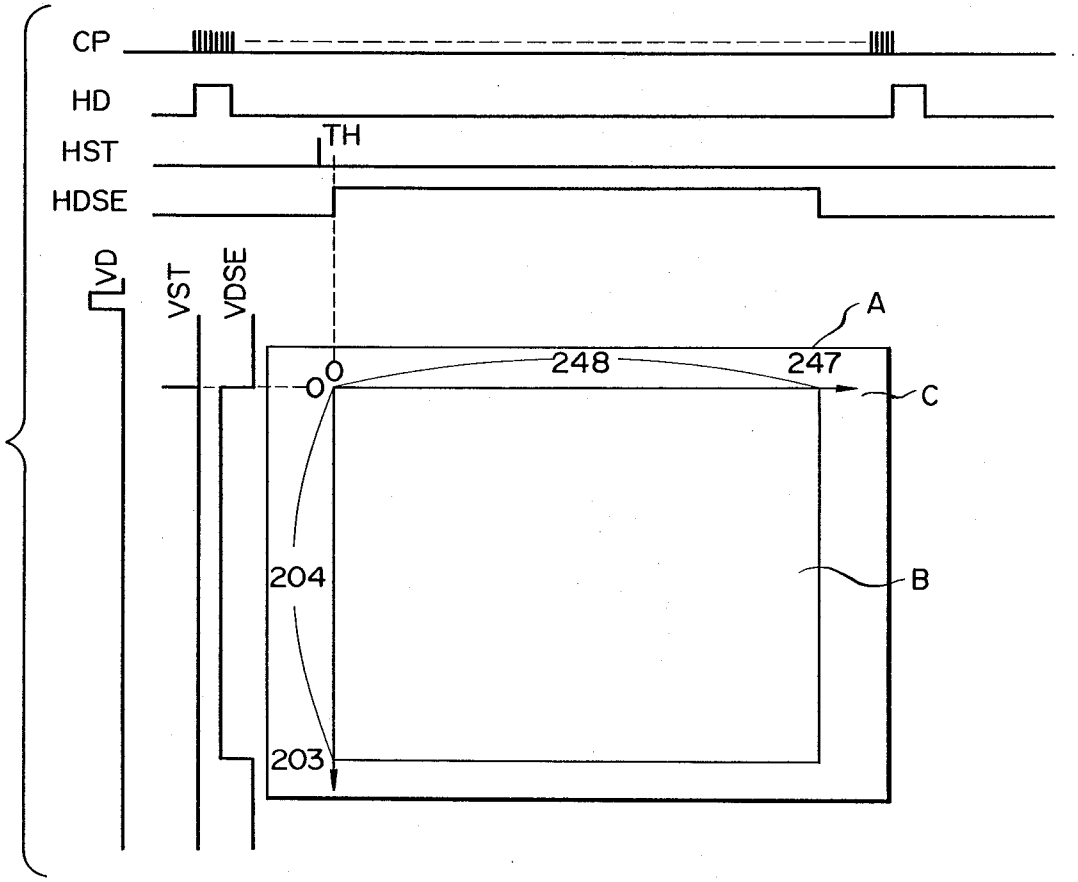
FIG. 2 is an explanatory view showing a configuration of an image display area of the first embodiment of FIG. 1.

An entire display area A of the display controller will be explained below as being divided into an image display area B of 248 dots (horizontal direction)×204 lines (vertical direction), i.e., a standard configuration for a teletext system, and a non-display area C, as shown in FIG. 2.

In FIG. 1, image memory 10 is a two-dimensional type with respective addresses corresponding to respective physical pixels in image display area B, as shown in FIG. 2. Image data items on the respective horizontal lines of the image display area B are stored in image memory 10.

During a display period of the eight-dot image data item, the next eight-dot image data item is read out of image memory 10 by read-out circuit 20.

Read-out circuit 20 includes counter (hereinafter referred to as an RH counter) 21 for generating a horizontal data readout address for display, and counter (hereinafter referred to as an RV counter) 22 for generating a vertical data readout address. RH counter 21 is an eight-bit counter for counting the number of display clock pulses CP supplied from oscillator 11. RH counter 21 is reset by a reset pulse HST which is delivered before eight display clock pulses CP from a horizontal display start time $T_H$, for every scanning time period, as shown in FIG. 2. Thus, during the respective eight-dot display period, the next eight-dot image data item is accessed from image memory 10.

RV counter 22 is an eight-bit type for counting the number of horizontal drive pulses HD, as set forth later. RV counter 22 is reset by a reset pulse VST which is delivered at a vertical display start time, as shown in FIG. 2. By counting the number of horizontal drive pulses HD, the vertical display line data item is fed into display memory 10.

The output addresses of RH counter 21 and RV counter 22 are supplied to image memory 10 through data selector 12, in which case a full-bit ($Q_0$ to $Q_7$) output of RV counter 22 is supplied to image memory 10, while only an upper five-bit ($Q_3$ to $Q_7$) output of RH counter 21 is supplied to image memory. Thus the eight-dot (one byte) parallel data is fed from image memory 10 to parallel/serial converter 23 which in turn delivers series data item $D_0$, with one dot as one unit, in accordance with the display clock pulse CP. Decoder 24 supplies a load pulse LDP to parallel/serial converter 23 to permit the parallel image data items from image memory 10 to be supplied to parallel/serial converter 23. Decoder 24 produces a load pulse LDP through use of an output corresponding to the lower three bits ($Q_0$ to $Q_2$) of RH counter 21. The load pulse LDP is delivered for every eight display clock pulses CP. Serial data item $D_0$ of converter 23 is supplied as an image data item D to display device 30 at image display area B alone (See FIG. 2) through AND gate 25, noting that it is gated at the non-display area C and thus not displayed on display device 30.

The gating of image data item D is achieved based on a composite display period signal C.DSE which is synthesized from horizontal and vertical display period signals HDSE and VDSE, and which is output from timing control circuit 40. Timing control circuit 40 supplies a composite synchronizing signal C.SYNC to display device 30 to permit the image data item to be synchronized with an interlaced scanning on display device 30.

The aforementioned timing control circuit 40 will be explained below:

The first embodiment, as well as a second embodiment, uses a synchronizing signal under the most commonly accepted NTSC system, which employs a composite synchronizing signal with horizontal and vertical synchronizing signals multiplexed. Horizontal counter (H counter) 41 permits the display clock pulse CP of a frequency 8/5 fsc (fsc: a color subcarrier frequency) which is supplied from oscillator 11, with one dot unit as a reference for image display, to be divided into a horizontal frequency $f_H$ ($f_H$: 15.75 KHz) for use on display device 30.

Here, the relation $$8/5\ \mathrm{fsc} = 364 \cdot f_H \qquad (1)$$

holds, and the frequency ratio of nine-bit H counter 41 is set, by a reset input, to 364. H decoder ROM 42 receives counter outputs $Q_0$ to $Q_8$ of H counter 41 as address inputs and produces various timing signals within a 1H horizontal period, such as a horizontal drive pulse HD to the reset input of H counter R, reset pulse HST to RH-counter 21, horizontal synchronizing signal HSYNC and horizontal display period signal HDSE (see FIG. 2) to mixer 45, as shown in FIG. 2. H decoder ROM 42 also supplies a pulse 2HD of a frequency $2f_H$ to vertical counter (V counter) 43.

V counter 43 frequency-divides the pulse 2HD into pulses of a vertical frequency $f_V$ ($f_V$: 60 Hz). Here, the relation of the horizontal frequency $f_H$ to the vertical frequency $f_V$ is:

$$2f_H = 525 \cdot f_V \qquad (2)$$

Ten-bit V counter 43 receives a reset input to obtain a frequency-division ratio of 525. V decoder ROM 44, like H decoder ROM 42, delivers, within a 1V synchronization period, various timing pulses. Among these timing signals are a vertical drive pulse VD for resetting V counter 43, a reset pulse $VST_1$ which is supplied to RV counter 22 through switch circuit 50, a VSYNC pulse for gating horizontal synchronizing signal HSYNC, and a vertical display period signal $VDSE_1$ (See FIG. 2). Here, V counter 43 receives the pulse 2HD as a clock pulse because the NTSC system requires a ½H timing period, on an interlaced scanning, for display.

Timing pulses from H and V decoder ROMs 42 and 44 are mixed by mixer 45 to provide the aforementioned composite signal C.SYNC and composite display period signal C.DSE. The composite display period signal C.DSE is supplied to AND gate 25 to permit the image data item $D_0$, which has been read out during the non-display period, to be masked.

Writing the image data into image memory 10 will be described below in more detail:

As known in the art, processor 13 decodes a teletext (-like) signal, which has been extracted from a television signal, through data take-in section (not shown), into image data. The image data item is supplied into a data bus and a stored address is supplied to an address bus, said address corresponding to the image data at a display position on the image display area (see FIG. 1). At this time, the stored address is supplied through selector 12 to image memory 10, and image data is fed through tristate data buffer 14 to image memory 10. To prevent the write-in address and the write-in image data from interfereing with the address and image data, both to be displayed, the vertical scanning period signal VBLK supplied from V decoder ROM 44 controls selector 12 and buffer 14, thereby writing the write-in image data within the vertical scanning period.

Next, switch circuit 50, which is a novel part of the first embodiment will be explained.

In accordance with the display state as set forth below, switch circuit 50 selectively delays the reset pulse $VST_1$ and vertical display period signal $VDSE_1$ by one horizontal period in an odd-numbered field. In paired scanning lines on which the same image data is formed this results in a switching of the lines associated with the field. For example, with the upper scanning line set at the odd-numbered field and the lower scanning line set at the even-numbered field. It is therefore possible to reduce flickering on the display screen under well-controlled interlaced scanning.

Figure 6B:
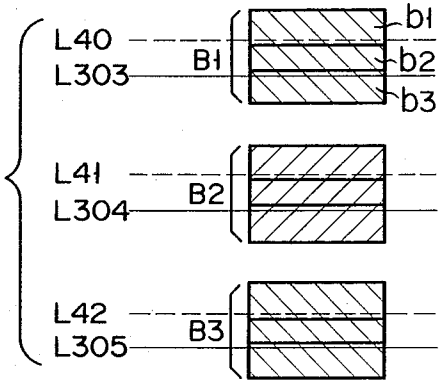
FIGS. 6A to 6D are schematic views for explaining an image display under interlaced scanning.
Figure 6D:
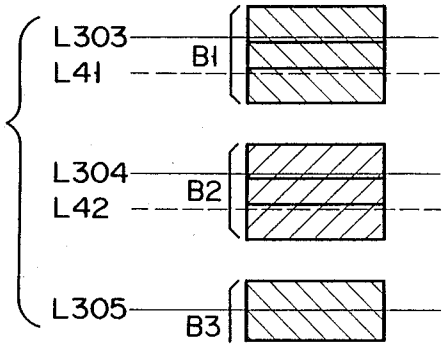
Figure 6A:
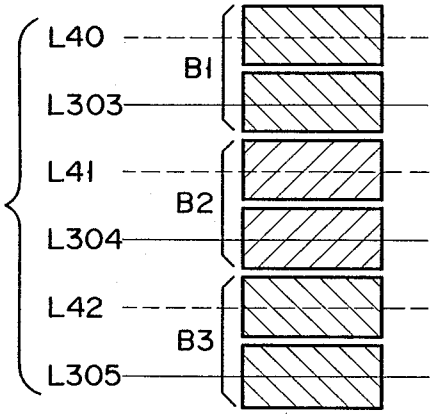

That is, in the case of an interlaced scanning as in FIG. 6B, no delay method is necessary. In the case of an interlaced scanning as in FIG. 6C, the set pulse $VST_1$ and display period signal $VDSE_1$ are delayed by one horizontal period, with the upper scanning line set at the even-numbered field, as shown in FIG. 6D.

Figures 3A, 3B:
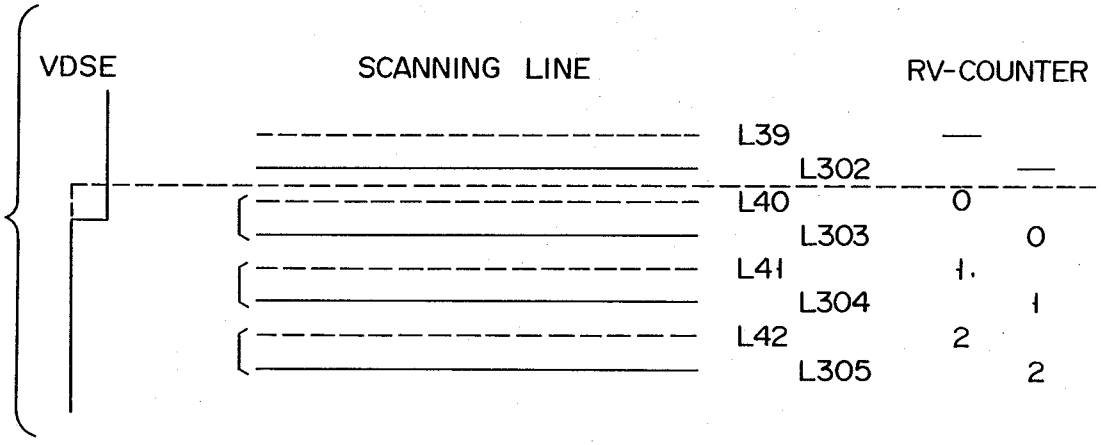
FIGS. 3A and 3B are views for explaining the operation of the first embodiment.

The switching of the even- and odd-numbered fields will now be explained in more detail, in connection with the case where reset pulse $VST_1$ is not delayed in the odd-numbered field, as shown in FIG. 3A, and where there is a delay of one horizontal period, as shown in FIG. 3B, with reset pulse $VST_1$ being delayed in the odd-numbered field.

The image display area B, as shown in FIG. 2, is defined by the aforementioned display period signal VDSE with 40 to 243H in the odd-numbered field and 303 to 506H in the even-numbered field. Since, in FIG. 3A, a count value "0" of RV counter 22 is used as a vertical display address in the scanning lines $L_{40}$ and $L_{303}$, the scanning line of the odd-numbered field is determined as being the upper side one of the paired scanning lines along which the same image data items are formed.

In the case of FIG. 3B, on the other hand, the reset pulse VST of RV counter 22 is delayed by one horizontal period and thus the update timing of RV counter 22 is delayed, with the result that the scanning lines $L_{303}$ and $L_{41}$ are determined, via the count value "0", as being the vertical display address. Thus, the scanning line of the even-numbered field is determined as being the upper side one of the paired scanning lines. The vertical display period signal VDSE, like the reset pulse VST, is delayed, thereby masking undecided image data item $D_0$ on the scanning line $L_{40}$.

Switch circuit 50 for switching the timing of the aforementioned reset pulse VST will be explained below with reference to the circuit of FIG. 4 and the timing charts of FIGS. 5A to 5K.

Figure 4:
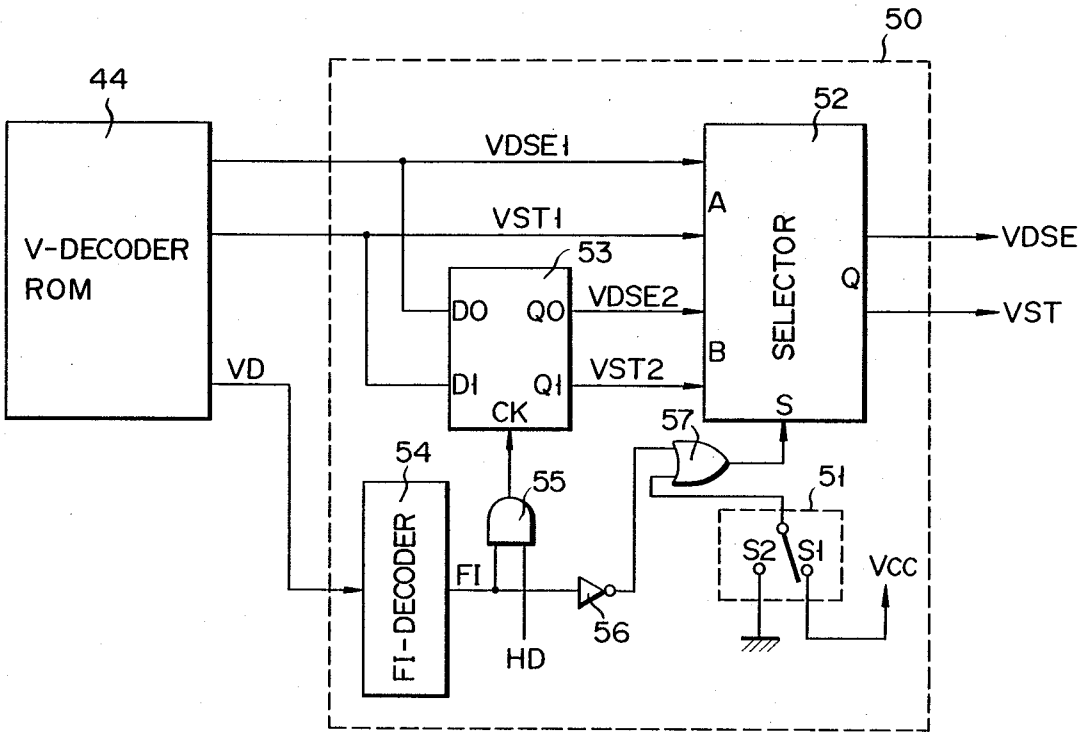
FIG. 4 is a circuit for showing a detail of one section of the first embodiment.

In FIG. 4, switch 51 is selectively thrown, based on the display state in accordance with which the scanning line of the even- or odd-numbered field is determined as being the upper side one of the paired scanning lines. With switch 51 thrown on the contact $S_1$ side, a select signal on selector 52 becomes "1" through OR gate 57, and irrespective of whether a field index FI (as set forth later) is "1" or "0", a display period signal $VDSE_1$ (FIG. 5D) and reset pulse $VST_1$ (FIG. 5E) from V decoder ROM 44 are delivered to selector 52, where they are delivered as signals VDSE and VST, respectively. The count value of RV counter 22 is updated and displayed on display device 30, as shown in FIG. 3A.

Figure 5:
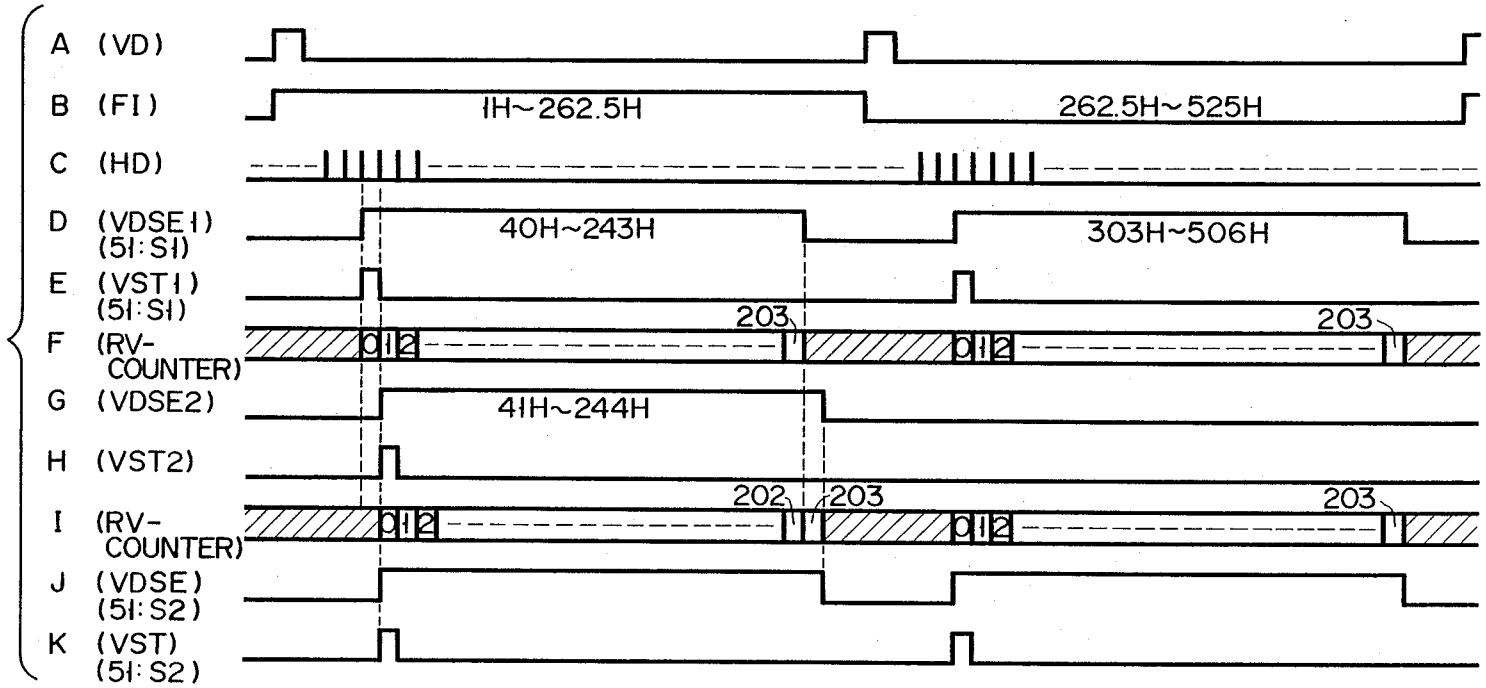
FIGS. 5A to 5K are timing charts showing an operation of the first embodiment.

With switch 51 thrown on the contact $S_2$ side, the signals $VDSE_1$ and $VST_1$ are delayed by one horizontal period in relation to only the odd-numbered field, by means of flip-flop 53, when field index FI is "1", as set forth later. These signals are supplied as "$VDSE_2$" (FIG. 5G) and $VST_2$ (FIG. 5H), respectively, to selector 52, where they are delivered as signals VDSE (FIG. 5J) and VST (FIG. 5K), respectively. In this case, when the field index FI is "1", the signals $VDSE_2$ ahd $VST_2$ emerge through inverter 56 and OR gate 57, and when the field index FI is "0", the signals $VDSE_1$ and $VST_1$ appear. At this time, determination of either the even-numbered field or the odd-numbered field is made by the field index FI (FIG. 5B), supplied from FI decoder 54. FI decoder 54 is comprised of a flip-flop whose previous state is inverted by a vertical drive pulse VD (FIG. 5A) supplied as one signal from Y decoder ROM for every field. The FI decoder delivers an output "1" for the odd-numbered field. A horizontal drive pulse HD (FIG. 5C) is gated by AND gate 55, in accordance with the field index FI supplied from FI decoder 54. The gate pulse is supplied as a clock pulse to flip-flop 53, where the display period signal $VDSE_1$ and reset pulse $VST_1$ are delayed only for every odd-numbered field. At this time the count value of RV counter 22 is as shown in FIG. 5I, to permit the scanning line of the even-numbered field to be determined as being the upper side one of the paired scanning lines (FIG. 3B).

Figure 6C:
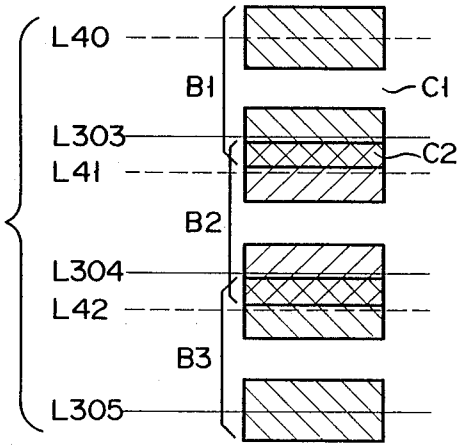

As shown in FIG. 6C, when the scanning line of the odd-numbered field is the upper one, the blocks of the corresponding pixels are separated from each other excessively due to the greater distance between the paired scanning lines, and further, the adjacent blocks partly overlap. If such is the case, flickering becomes noticeable.

To prevent the intense flickering, switch 51 is changed over to contact $S_2$, whereby the scanning line of the even-numbered field is paired with the scanning line of the other nearer odd-numbered field. In other word, the display mode is changed such that two closer scanning lines are paired as shown in FIG. 6D. As a result, some of the pixels formed on one of the newly paired scanning lines overlap some of the pixels formed on the other scanning line, thus reducing the flickering.

As set out above, it is posible to reduce flickering on the display screen under well-controlled interlaced scanning, in accordance with this invention so that a better image display can be obtained. In this embodiment not only the reset pulse VST but also the display period signal VDSE is delayed, thus permitting any unwanted display data item to be gated.

Although in the first embodiment the reset pulse is delayed by one horizontal period, this invention is not restricted thereto.

Figure 7:
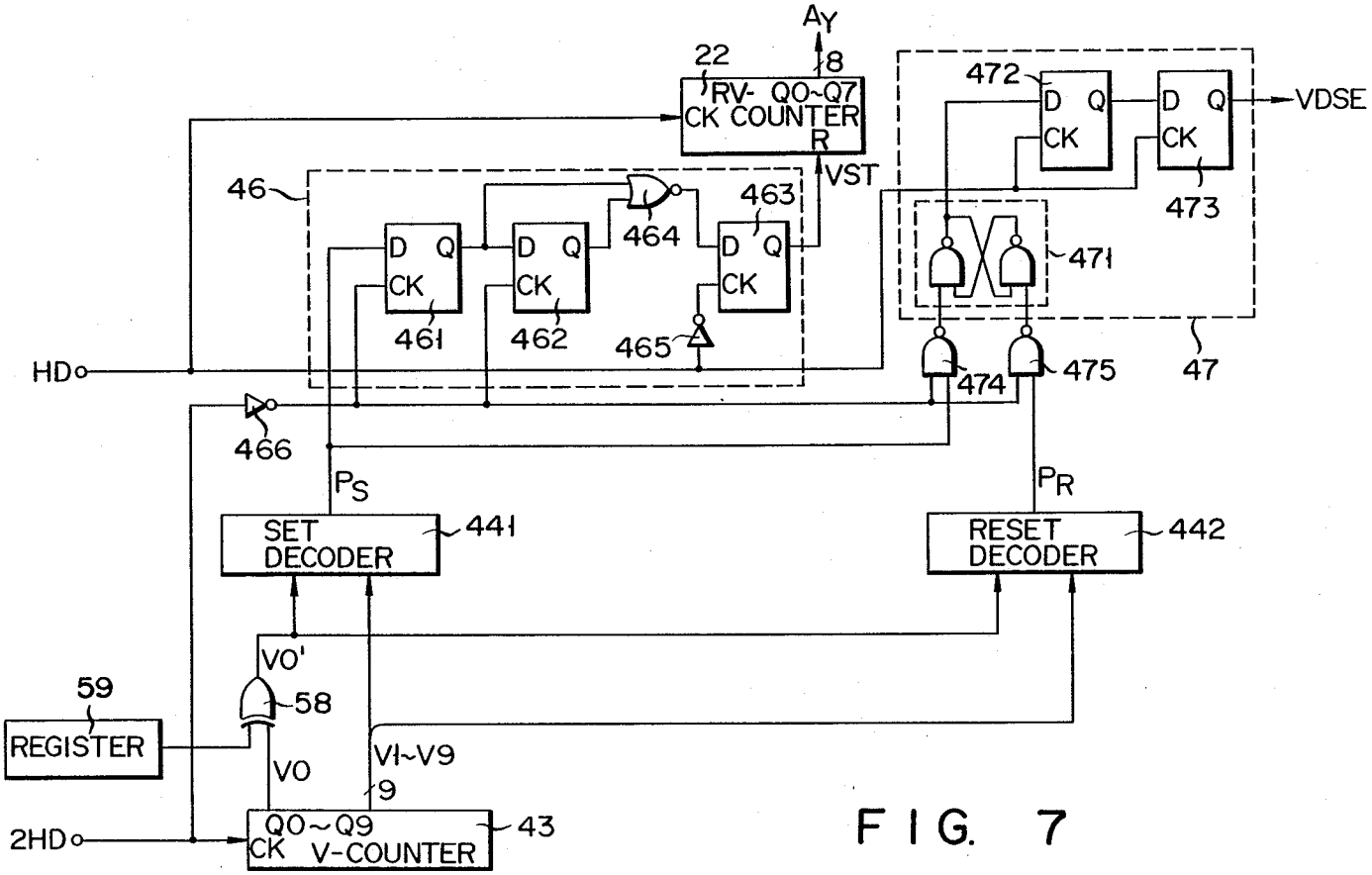
FIG. 7 is a circuit diagram showing an arrangement according to a second embodiment of this invention.

FIG. 7 is a circuit diagram showing a major part of a second embodiment of this invention with a peripheral circuit (not shown) for an image memory, a read-in control circuit, and a timing control circuit of horizontal relations resembling that of FIG. 1. V counter 43 is adapted to count the number of clock pulses 2HD whose frequency is double that of the horizontal scanning frequency. The count value is used as a reference for controlling various vertical image display timings in relation to the aforementioned display area.

Reference numerals 441, 442 show set and reset decoders, respectively, which determine the rise and fall of a timing signal VDSE for a vertical display area. When the count value of V counter 43 reaches a predetermined value, it generates a set pulse $P_S$ and reset pulse $P_R$.

Register 59 is of a type for storing one-bit data items for enabling set decoder 441 and reset decoder 442 when $V_0=1$ ($V_0$: the lowest order bit of V counter 43) or enabling these decoders when $V_0=$"0".

Exclusive OR circuit 58 converts a value of the lowest order bit $V_0$ of V counter 43 in accordance with data stored in register 59.

Clear circuit 46 clears RV counter 22 which generates vertical display address data item $A_Y$. This circuit comprises D flip-flop circuits 461, 462 and 463, NOR circuit 464, and inverter 465, and generates a "reset" signal VST through RV counter 22 by use of the set pulse $P_S$ from set decoder 441, clock pulse HD of a horizontal scanning frequency, and clock pulse 2HD which is supplied through inverter 466.

NAND circuits 474 and 475 eliminate noise components from the outputs of set and reset decoders 441 and 442 by use of the aforementioned clock pulse 2HD from inverter 466.

Timing signal generator 47 delivers a vertical display period signal VDSE for the aforementioned vertical image display area, and comprises RS flip-flop circuit 471 and D flip-flops 472 and 473. RS flip-flop 471 is set by a "set" pulse $P_S$ from set decoder 441 and reset by a "reset" pulse $P_R$ from reset decoder 442, so that it generates the aforementioned vertical display period signal VDSE. D flip-flops 472 and 473 in timing signal generator 47 are used to enable the timing signal VDSE to be synchronized with the clock pulse HD.

Figure 8:
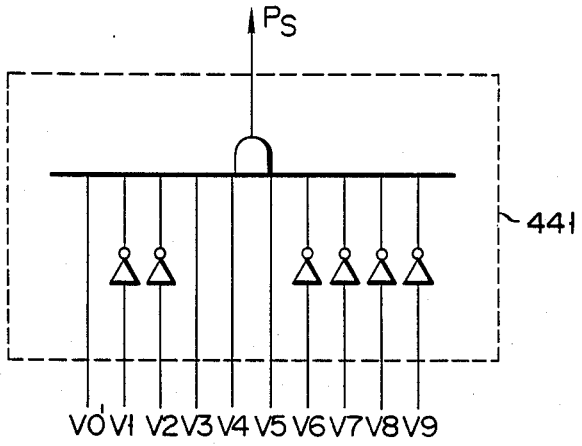
FIGS. 8 and 9 each show one detailed form of set and reset decoders shown in FIG. 7.
Figure 9:
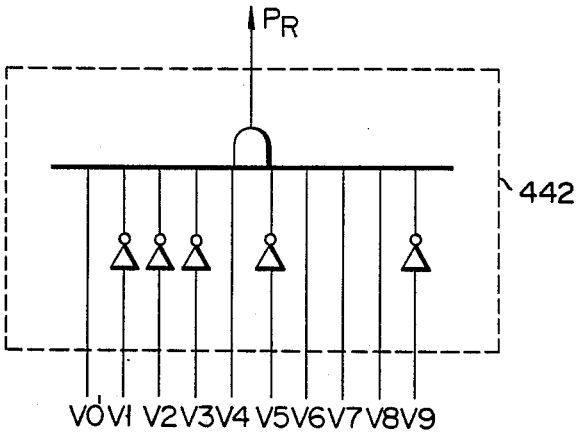

Set decoder 441 is of a configuration as shown in FIG. 8, and generates a set pulse $P_S$ when input value "$V_9 V_8 V_7 V_6 V_5 V_4 V_3 V_2 V_1 V_0$'" is "0000111001" (57 in binary notation). Reset decoder 442 is of a configuration as shown in FIG. 9, and generates a reset pulse $P_R$ when input value "$V_9 V_8 V_7 V_6 V_5 V_4 V_3 V_2 V_1 V_0$'" is "0111010001" (465 in binary notation).

Figure 10:
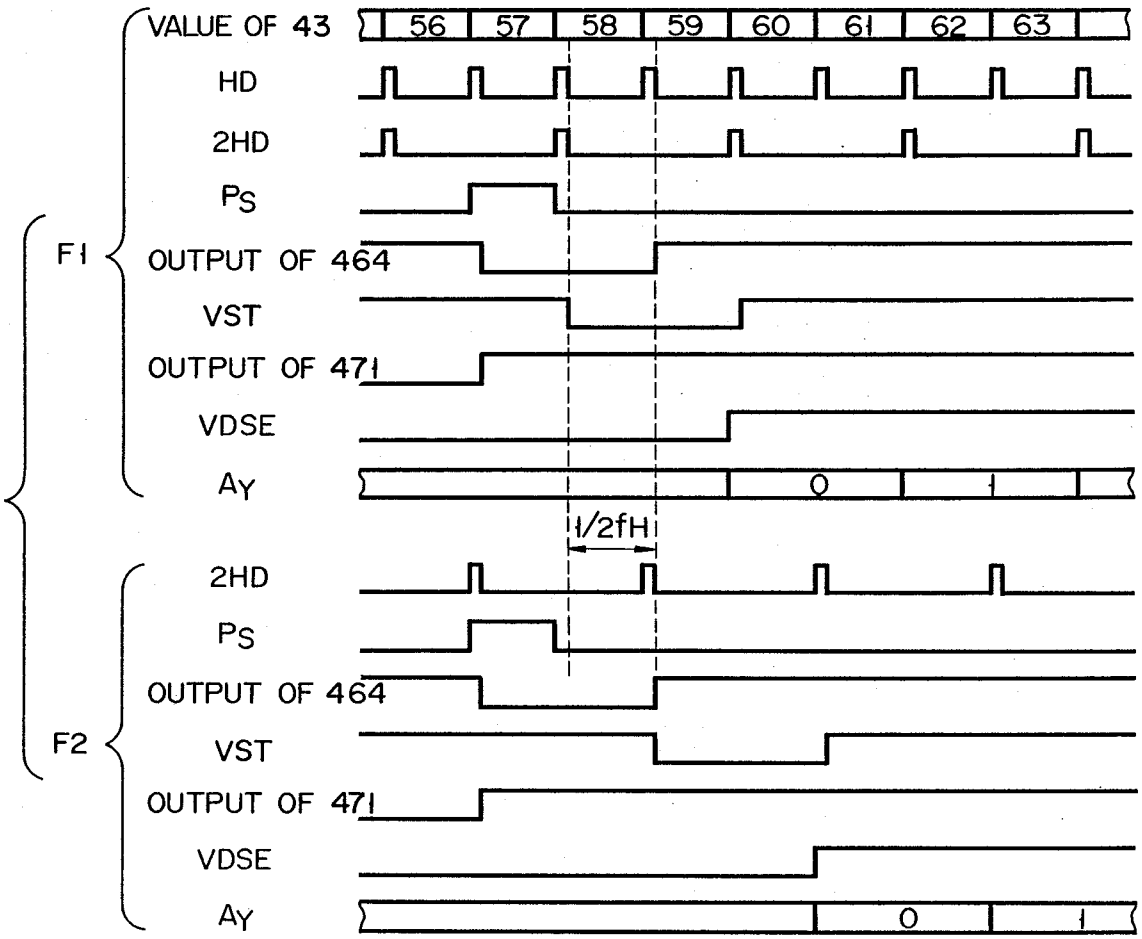
FIGS. 10 and 11 each show a timing chart for explaining the operation of the circuit diagram of FIG. 7.
Figure 13:
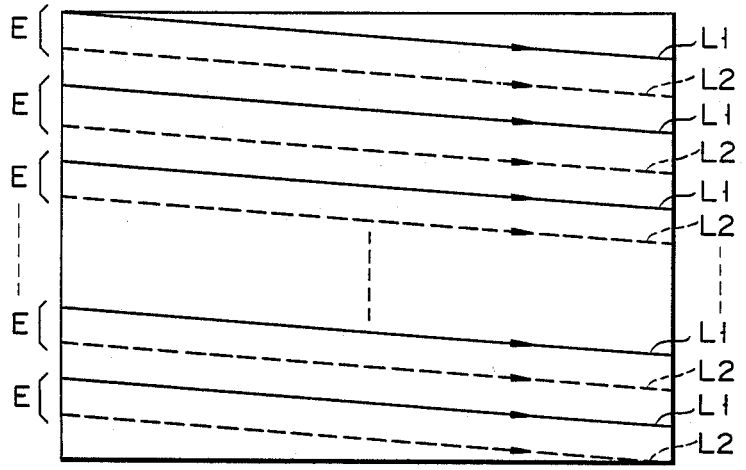
FIG. 13 is a view for explaining an interlaced display system.

The operation of the second embodiment will now be explained below:

With register 59 set to "0", for example, an output $V_0'$ of exclusive OR circuit 58 becomes "1" when $V_0=$"1", and "0" when $V_0=$"0". When count value "$V_9 V_8 V_7 V_6 V_5 V_4 V_3 V_2 V_1 V_0$" of V counter 43 is "0000111001" (57 in binary notation), set decoder 441 delivers a set pulse $P_S$. FIG. 10 shows a timing chart of respective associated parts at this time. As shown in FIG. 10, with register 59 set to "0", the vertical display period signal VDSE and "reset" signal VST are such that the first field $F_1$ is advanced from the second field $F_2$ by an amount $\frac{1}{2}f_H$ where $f_H$ indicates a horizontal scanning frequency. In this case, as shown in FIG. 13, one vertical pixel E is located on a scanning line $L_1$ of a first (an odd-numbered) field $F_1$ and on scanning line $L_2$ of a second (an even-numbered) field $F_2$. Where a deflection system of a monitor has the characteristics shown in FIG. 14, the distance between adjacent image blocks of one pixel on two types of scanning lines coming from the same image data address, is smaller, with the result that flickering on the display screen is reduced in its vertical direction. Where, on the other hand, a deflection system of a monitor has the characteristics shown in FIG. 15, the distance between adjacent image blocks on two types of scanning lines coming from the same image data address, is greater, with the result that flickering on the display screen is increased in its vertical direction.

Figure 11:
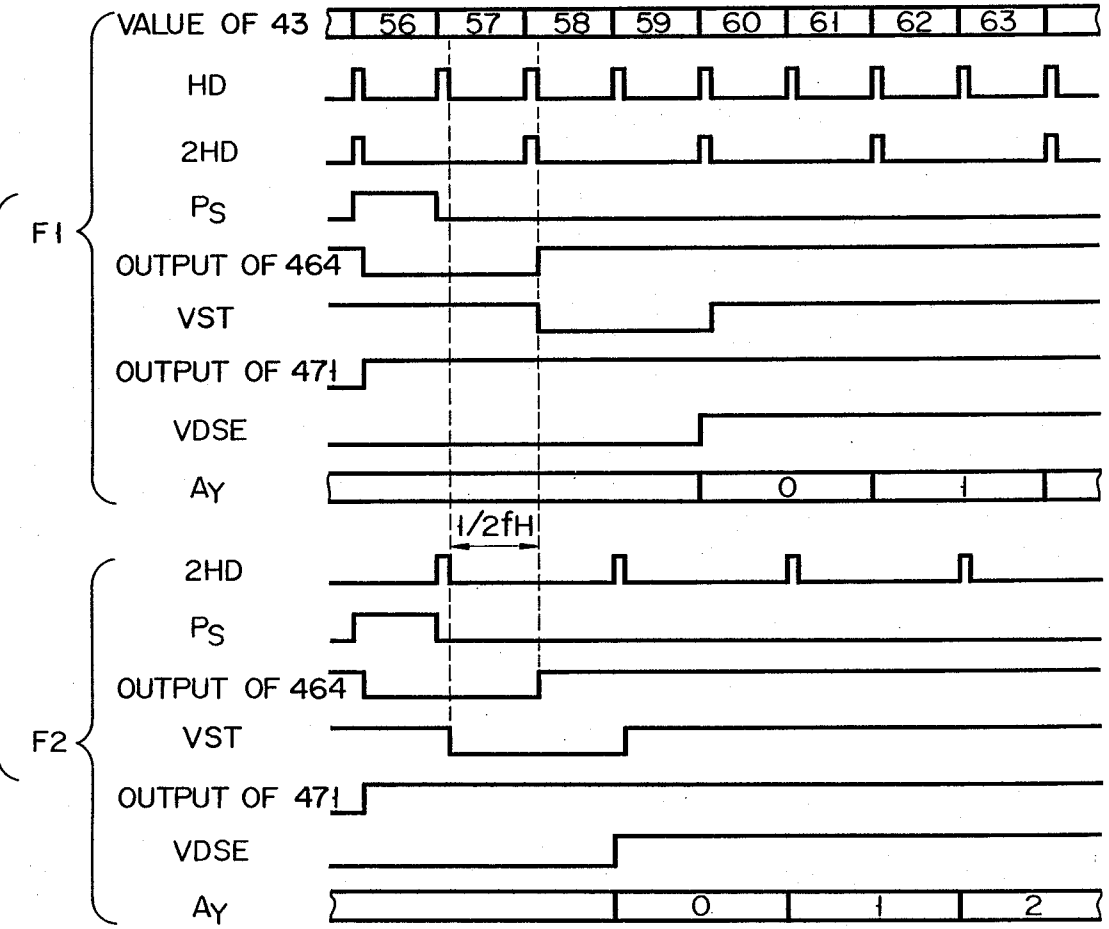
Figure 12:
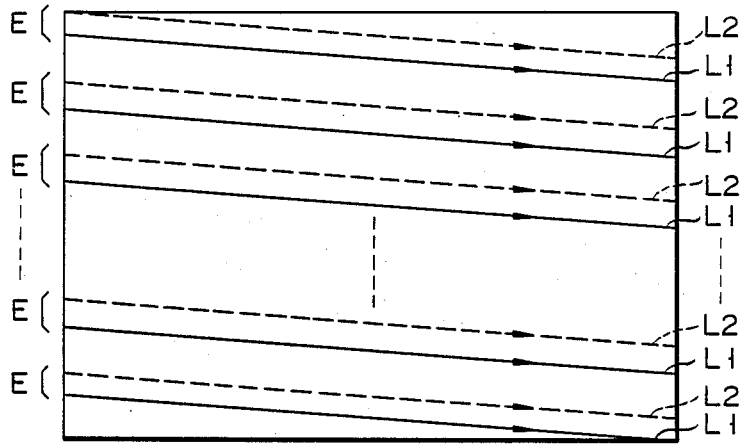
FIG. 12 shows the operation of the embodiment of FIG. 7.
Figure 14:
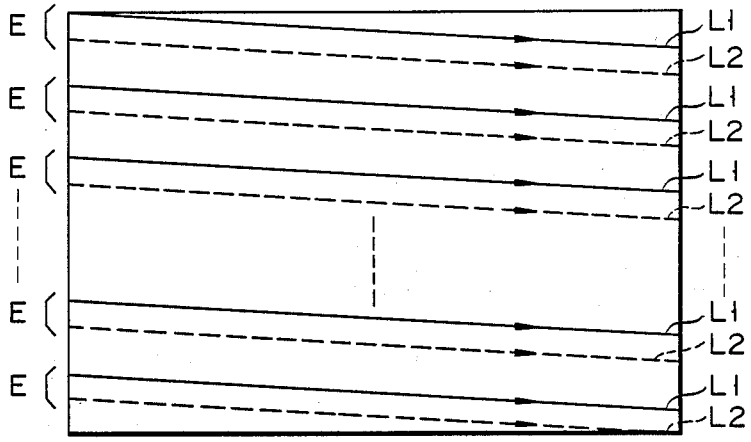
FIGS. 14 and 15 are views showing displacement of the scanning lines.
Figure 15:
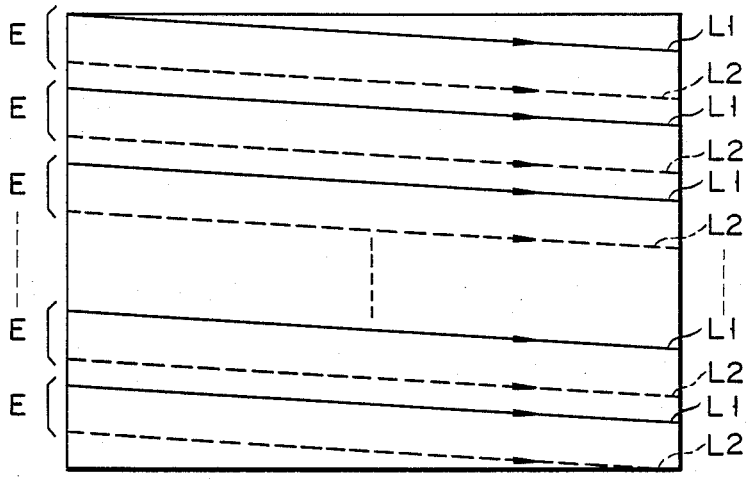

Setting register 59 to "1" will now be explained below in more detail:

In this case, the output $V_0'$ of exclusive OR circuit 58 becomes "1" when the lowest order bit $V_0$ of V counter 43 is "0", and "0" when $V_0$ is "1". When, therefore, the count value "$V_9 V_8 V_7 V_6 V_5 V_4 V_3 V_2 V_1 V_0$" of V counter 43 is "0000111000" (56 in binary notation), the set pulse $P_S$ is generated from set decoder 441. FIG. 11 shows a timing chart of respective associated parts at this time. As is evident from FIG. 11, when "1" is set to register 59, the vertical display period signal VDSE and "reset" signal VST are such that the second field $F_2$ is advanced from the first field $F_1$ by an amount $\frac{1}{2}f_H$, in which case, as shown in FIG. 12, one pixel E is formed on the scanning line $L_1$ of the first field $F_1$, and overlying scanning line $L_2$ of the second field $F_2$ in the vertical direction. If a deflection system of a monitor possesses a characteristic such as is shown in FIG. 14, the distance between the adjacent blocks of one pixel on two kinds of scanning lines $L_1$ and $L_2$ coming from the same image data address, is greater in the vertical direction, thus increasing flickering on the display screen in the vertical direction. If a deflection system of a monitor has the characteristic shown in FIG. 15, the distance between the display blocks of the pixel on the paired scanning lines in the vertical direction, is smaller on the display screen, thus improving the image on the display screen, without flickering occurring in the vertical direction. It should be noted that in FIGS. 10 and 11 the count number, around 60, of V counter 43, corresponds to around 40H.

Once a data value to be set to register 59 is determined, in accordance with the characteristics of the deflection system of the monitor, then the distance between the paired scanning lines $L_1$ and $L_2$, along which the pixel is formed, is smaller on the display screen in the vertical direction. It is therefore possible to obtain a flickerless image in the vertical direction irrespective of the characteristics of the aforementioned deflection system.

In the preceding embodiment, register 59 and exclusive OR circuit 58 alternately supply a noninverting or an inverting output of the lowest order bit $V_0$ of V counter 43. In this arrangement, for example, the lowest order bit $V_0$ is alternatively selected by a switch through or without an inverter.

This invention is not restricted to the teletext system.

According to this invention, as set out in more detail above, the fields of upper and lower ones of the paired scanning lines are alternately set in accordance with the state of the interlaced scanning. Thus, the adjacent blocks of the pixel on the paired scanning lines can be displayed in an overlapped fashion, thus reducing flickering on the display screen. It is therefore possible to display a still image in an interlaced scanning fashion, with resultant better visibility.

What is claimed is:

1. A raster scan image data display controller comprising:

an image memory for storing image data items at horizontal and vertical display addresses corresponding to horizontal and vertical coordinates in an image display area, for display;

read-out means for supplying the horizontal and vertical display addresses to the image memory and reading out the image data item from the image memory;

display means for interlaced displaying of the read-out image data item on adjacent paired scanning lines of two types of fields which are to be formed by a raster scan, the interval between said adjacent paired scanning lines being substantially different from a predetermined distance;

timing control means for synchronizing the horizontal and vertical display addresses supplied from said read-out means with the raster scan of the display means; and timing switching means for alternatively switching said adjacent paired scanning lines of said two types of fields formed by the raster scan, in association with a timing control of the horizontal and vertical display addresses by the timing control means, so as to select another adjacent paired scanning lines which are situated close to each other, said another adjacent paired scanning lines being formed by one scanning line of said adjacent paired scanning lines and one scanning line of adjacent paired scanning lines which are next to said adjacent paired scanning lines when the interval of said adjacent paired scanning lines of said display is wider than the predetermined distance.

2. A raster scan image data display controller according to claim 1, wherein said timing switching means includes:

means for selectively switching to a first timing for updating said vertical display address, means for altering said first timing by one horizontal period which equals one scanning field of said raster scan of said display device, in accordance with said timing control means, and means for supplying said first timing or said altered first timing to said read-out means.

3. A raster scan image data display controller according to claim 2, wherein said alteration of said one horizontal period is achieved by a delay of one horizontal period.

4. A raster scan image data display controller according to claim 2, wherein said timing switching means includes means for suppressing unwanted display data items by altering a vertical display period-determining timing by one horizontal period.

5. A raster scan image data display controller according to claim 1, wherein said timing switching means includes:

means for selectively switching to a first decoding value or to a second decoding value which are associated with a decoding timing for determining a vertical display address by said timing control means and obtained by altering a value corresponding to one horizontal period of said first decoding value, and means for supplying said switched decoding value to said read-out means.

6. A raster scan image data display controller according to claim 5 wherein said first decoding value is supplied as a non-inverted output corresponding to the lowest order bit of an input to be decoded, and said second value is supplied as an inverted output corresponding to the lowest order bit of the input to be decoded.

* * * * *

UNITED STATES PATENT AND TRADEMARK OFFICE

CERTIFICATE OF CORRECTION

PATENT NO. : 4,788,540

DATED : November 29, 1988

INVENTOR(S) : Shigenori Tokumitsu; Masaki Nishiura

It is certified that error appears in the above-identified patent and that said Letters Patent is hereby corrected as shown below:

ON THE FIRST INFORMATION PAGE:

(30) Foreign Application Priority Data should only include -- July 19, 1985 (JP) Japan 60-159340 -- since the priority was claimed only for that number. Please delete Feb. 20, 1985 (JP) Japan 60-30289.

Signed and Sealed this

Twenty-third Day of May, 1989

*Attest:*

*Attesting Officer*

DONALD J. QUIGG

*Commissioner of Patents and Trademarks*